United States Patent [19]

Motosko, II

[11] Patent Number: 4,570,519

[45] Date of Patent: Feb. 18, 1986

[54] VEGETABLE SLICER WITH THICKNESS ADJUSTMENT

[76] Inventor: Stephen J. Motosko, II, 120 Pittsburgh St., Columbiana, Ohio 44408

[21] Appl. No.: 645,676

[22] Filed: Aug. 30, 1984

[51] Int. Cl.[4] ..... B26D 3/28

[52] U.S. Cl. ..... 83/856; 30/283

[58] Field of Search ..... 83/856, 858, 446, 431; 30/283, 278

[56] References Cited

U.S. PATENT DOCUMENTS

| | | | |
|---|---|---|---|
| 48,118 | 6/1865 | Walker | 83/856 |
| 66,402 | 7/1867 | Schwartz | 83/856 |
| 221,436 | 11/1879 | Andrews | 83/856 |
| 4,038,892 | 8/1977 | Popeil | 83/858 X |

FOREIGN PATENT DOCUMENTS

| | | | |
|---|---|---|---|
| 664477 | 9/1938 | Fed. Rep. of Germany | 83/856 |

*Primary Examiner*—Frank T. Yost

*Attorney, Agent, or Firm*—Harpman & Harpman

[57] ABSTRACT

A vegetable slicer has an integral body with a generally flat portion, a diagonally arranged opening partially transversely of said top portion and a section of said top portion on one side of said opening separated from the remainder of the top portion by longitudinal cutaway areas so that said section may be moved up and down relative to a knife positioned longitudinally of said diagonal opening. A cam device is provided for moving the section of the top portion vertically.

4 Claims, 4 Drawing Figures

VEGETABLE SLICER WITH THICKNESS ADJUSTMENT

BACKGROUND OF THE INVENTION

1. Technical Field

This invention relates to slicing devices such as disclosed in U.S. Pat. Nos. 4,120,089 and 4,290,196 wherein slicing devices are disclosed on which a vegetable, such as a potato, to be sliced can be reciprocated and slices separated therefrom.

2. Description of the Prior Art

Prior structures of this type have provided fixed portions along which the vegetable to be sliced is moved and relatively fixed cutting blades. Some of the devices have used interchangeable body sections in order to vary the thickness of the slices of vegetables sliced thereon and others have changed the arrangement of the slicing blades from transverse to diagonal and to V-shape.

The present invention provides a simple, inexpensive integral body, the top portion of which has a section partially separated from the remainder so that it is bendable with its free edge movable vertically relative to a knife positioned in spaced parallel relation to the free edge whereby the thicknesses of slices of vegetables can be readily controlled.

SUMMARY OF THE INVENTION

A vegetable slicer comprises a molded integral body with a substantially flat top portion, a section of which is separated on three edges from the top portion so as to be movable in hinged relation thereto. Cams on the section engage a transversely movable cam bar for imparting vertical movement to the section and brackets on the top portion position a knife transversely thereof with its cutting edge in spaced relation to the free movable edge of the section of the top portion.

DESCRIPTION OF THE DRAWINGS

FIG. 3 is a vertical section on line 3—3 of FIG. 1; and

DESCRIPTION OF THE PREFERRED EMBODIMENT

Figure 1:
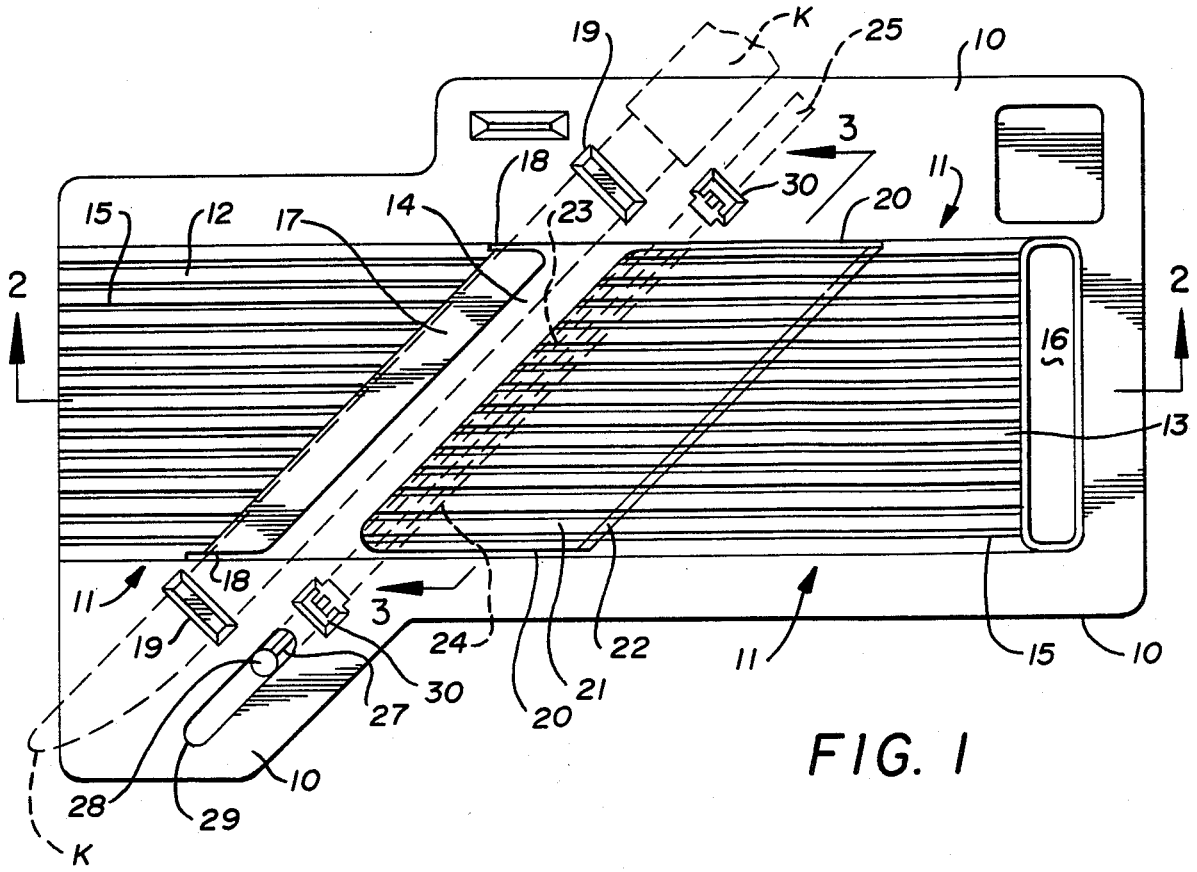
FIG. 1 is a top plan view of the vegetable slicer.
Figure 2:
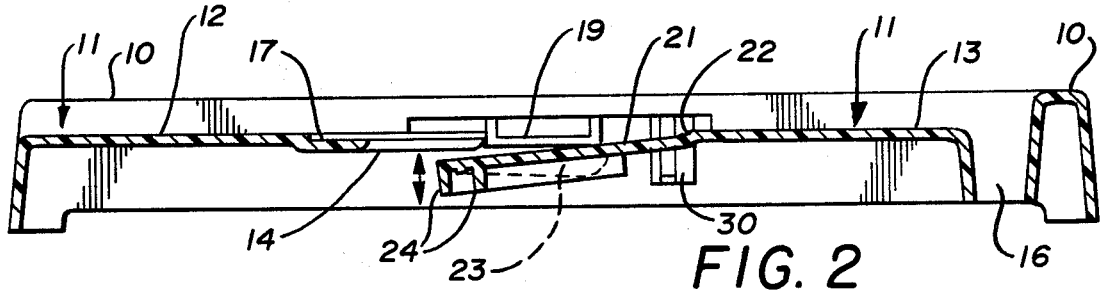

In the form of the invention chosen for illustration herein, the vegetable slicer with thickness adjustment consists of an integral body member 10 molded of a suitable synthetic resin. As seen in FIGS. 1 and 2 of the drawings, the body member 10 has a depressed generally flat top portion 11 separated into two sections 12 and 13 by a diagonal opening 14. Longitudinal grooves 15 are formed in each of the sections 12 and 13 and extend to the end of the flat top portion 11 at one end thereof and to a secondary opening 16 adjacent the other end thereof.

A portion 17 of the section 12 adjacent the diagonal opening 14 is offset downwardly with respect to the remainder of the section 12 and is separated at its ends from the flat top portion 11 by slots 18. It forms a surface for receiving and supporting a knife such as shown in broken lines in FIG. 1 of the drawings and indicated by the letter K.

Figure 3:
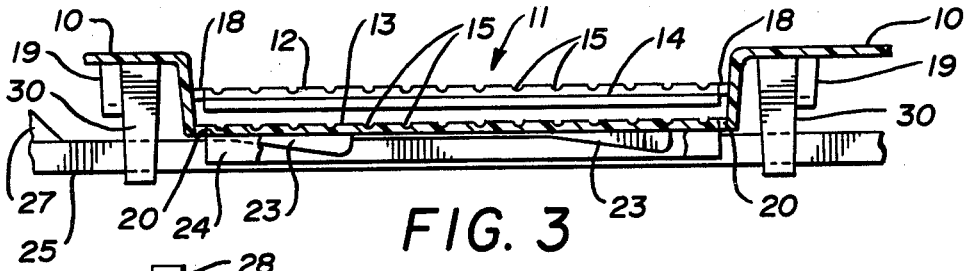
FIG. 3 is a vertical section on line 2—2 of FIG. 1.

By referring to FIGS. 1 and 3 of the drawings, it will be seen that depending brackets 19 are formed on the side portions of the flat top 11 of the device so that a knife, such as a butcher knife, can be positioned therethrough on a diagonal line the same as the diagonal opening 14 heretofore referred to and so that the knife will partially rest on the downwardly offset portion 17 of the section 12 with the non-cutting edge adjacent the offset which spaces the portion 17 slightly below the section 12 of the flat top portion 11.

Figure 4:
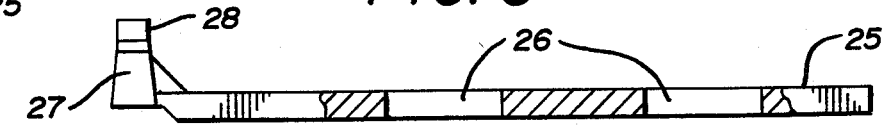
FIG. 4 is a side elevation of a cam bar with parts broken away and parts in cross section partially seen in FIGS. 1 and 3.

The section 13 of the flat top portion 11 on the other side, the right side as seen in FIGS. 1 and 2 of the drawings, has substantially half thereof, the left half as seen in FIGS. 1 and 2 of the drawings, separated at its longitudinal edges from the flat top portion 11 by secondary slots 20 so as to form an extending movable adjustment section 21. The adjustment section 21 has its free edge defining one side of the diagonal opening 14 and its opposite edge defining a hinge area 22 which is diagonally positioned across the section 13 of the depressed flat top portion 11 of the device. The adjustable section 21 and particularly its free edge defining the diagonal opening 14 is thus movable vertically so that a vegetable slid from right to left thereacross will engage a knife partially positioned on the offset portion 17 of the section 12 of the device so as to slice the vegetable at a thickness determined by the position of the adjustable section 21 and its free edge in particular. In order that the adjustable section 21 can be moved vertically, a pair of cams 23 are formed on the lower surface thereof as best seen in FIGS. 2 and 3 of the drawings. The cams 23 are positioned between a spaced pair of depending flanges 24 formed on the adjustable section 21 immediately adjacent its free edge which defines one side of the diagonal opening 14 in which the knife K is positioned. The flanges 24 are spaced with respect to the cams 23 as best seen in FIG. 2 of the drawings so that a cam bar 25 having longitudinally spaced vertically openings 26 therethrough can be slidably positioned between the flanges 24 for movement longitudinally of the cams 23. The cam bar 25 is illustrated in FIGS. 1 and 4 of the drawings and partially illustrated in FIG. 3 of the drawings and by referring thereto it will be seen that it has an upstanding end portion 27 with a round knob 28 on its upper end, the portion 27 and the knob 28 being positioned vertically through an elongated diagonally positioned slot 29 in the integral body 10 of the device so that the rounded knot 28 can be moved longitudinally of the slot 29 and thus move the cam bar 25 and its vertical openings 26 relative to the cams 23, which action will cause the adjustable section 21 to move vertically and thus control the thickness of slices of a vegetable slid thereacross and sliced by the cutting edge of the knife K.

The cam bar 25 is held in fixed vertical relation to the integral body member 10 by a pair of secondary depending brackets 30 formed on the lower surface thereof as best illustrated in FIGS. 1 and 3 of the drawings.

It will occur to those skilled in the art that the particular overall shape of the integral body member 10 as illustrated in the present disclosure is not critical to the operation of the device as the novelty is believed to reside in the arrangement and formation of the adjustable section 21 and its hinged integral attachment to the section 13 of the depressed area 11 of the body member 10 together with the devices by which the knife, such as an ordinary butcher knife, can be slidably positioned in the vegetable slicer and most importantly the cam bar and its slot-like openings registrable with the cams on the adjustable section 21 for moving the same vertically so as to select the thickness of slices of vegetables being sliced on the device.

It will occur to those skilled in the art that if desired an attachment can be positioned on the offset portion 17 which underlies the knife K and present a series of spaced cutting members positioned above the knife K so that slices of a vegetable moving thereacross will be divided into a plurality of narrow strips.

Alternately, a modified knife with right angular upstanding cutting edges can be substituted for a conventional knife with the result that strips of slices vegetables of desired thickness can be readily formed on the vegetable slicer of the invention and having thus disclosed my invention, what I claim is:

1. In a vegetable slicer for cutting vegetables, fruit and the like into portions, such as slices, said slicer having an integral horizontally disposed portion with an opening transversely thereof, a section of said integrally horizontally disposed portion being formed in freely extending relation with respect to an adjacent section of said horizontal portion and defining one side of said opening, another section of said horizontal portion defining the other side of said opening, means on said slicer for positioning a knife longitudinally of said transverse opening and adjacent said freely extending section, cams on said freely extending section and a cam bar movably positioned on said vegetable slicer for engagement with said cams for moving said freely extending section vertically so that a vegetable being moved longitudinally of the device and across said opening may be selectively presented to a knife in said opening so as to control the thickness of slices removed from said vegetable.

2. The vegetable slicer set forth in claim 1 and wherein said opening is arranged diagonally of said integral horizontally disposed portion.

3. The vegetable slicer set forth in claim 1 and wherein said means on said slicer for positioning a knife longitudinally of said transverse opening comprises an offset ledge on said section of said horizontal portion defining the other side of said opening and a pair of brackets on said slicer having portions in transverse alignment with said ledge for holding said knife.

4. The vegetable slicer set forth in claim 1 and wherein said freely extending section of said horizontal portion is separated from said integral horizontally disposed portion by longitudinally extending slots extending at right angles to said opening.

* * * * *